United States Patent [19]

Xuan

[11] Patent Number: 5,007,863

[45] Date of Patent: Apr. 16, 1991

[54] MODULE-TYPE MULTI-FUNCTION ELECTRICAL POWER ADAPTER FOR AUTOMOBILES AND THE LIKE

[76] Inventor: Jialuo Xuan, 914 Sherman Ave., #2F, Evanston, Ill. 60202

[21] Appl. No.: 583,689

[22] Filed: Sep. 17, 1990

[51] Int. Cl.[5] ..... H01R 25/00

[52] U.S. Cl. ..... 439/639; 439/654; 439/76

[58] Field of Search ..... 439/638–655, 439/668, 669, 715, 716, 717, 718

[56] References Cited

U.S. PATENT DOCUMENTS

| | | | |
|---|---|---|---|
| 2,145,355 | 1/1939 | Hastings . | |
| 2,670,422 | 2/1954 | Baum et al. . | |
| 2,954,544 | 9/1960 | Focosi . | |
| 2,960,673 | 11/1960 | Young . | |
| 3,040,151 | 6/1962 | Reihman et al. . | |
| 3,047,773 | 7/1962 | Morton | 439/651 |
| 3,048,805 | 8/1962 | Berni . | |
| 3,324,260 | 6/1967 | Schumacher . | |
| 3,865,463 | 2/1975 | Busch | 339/176 |
| 4,011,000 | 3/1977 | Wharton | 339/130 C |
| 4,054,352 | 10/1977 | Rudin | 339/154 A |
| 4,109,988 | 8/1978 | Olson | 339/91 R |
| 4,163,965 | 8/1979 | Misinchuk | 338/220 |
| 4,180,302 | 12/1979 | Gordon | 339/143 T |
| 4,220,834 | 9/1980 | Holce et al. | 179/190 |
| 4,248,494 | 2/1981 | McDonald et al. | 339/154 A |
| 4,270,038 | 5/1981 | Warihashi | 219/269 |
| 4,319,798 | 3/1982 | Mittelhauser | 339/154 R |
| 4,322,122 | 3/1982 | Schwartz et al. | 339/147 P |
| 4,659,161 | 4/1987 | Holcomb | 439/652 |
| 4,740,167 | 4/1988 | Millhimes et al. | 439/640 |
| 4,960,393 | 10/1990 | Stoll et al. | 439/651 |

*Primary Examiner*—David L. Pirlot

[57] ABSTRACT

This specification discloses a module-type multi-function power outlet adapter for use of add-on electrical accessories in an automotive vehicle having a cigarette lighter socket. This device embodies a plurality of separate detachable modules which may be attached to a basic module insertable into the lighter socket and constructed to receive the additional modules, so to provide multiple electrical outputs. Such a module-type arrangement allows the adapter to fit the mounting space of cigarette light socket in various vehicles, boats, campers, and the like. A simple positioning pin structure ensures correct power leads connection and secures the combination between modules. The resulting solid structure allows easy reception for plug-in accessory equipment. In addition, this device acts as a power system protector by monitoring the voltage level and controlling the power use of those accessories no matter whether the engine is running or stopped. Furthermore, this device is also a power system tester by providing information on the working condition of battery, generator, and regulator in an automotive vehicle and the like.

3 Claims, 5 Drawing Sheets

4.
13
13'
22
19
3.
18
37
12
16
33
34
15
28
27
29
30
31
32
11
26
10
35
36

32
30
26'

17
38
39

5.
6.
40
41
14
14'
26"

21
22'

MODULE-TYPE MULTI-FUNCTION ELECTRICAL POWER ADAPTER FOR AUTOMOBILES AND THE LIKE

BACKGROUND OF THE INVENTION

1. Field of the Invention

The invention relates generally to power adapter devices and more particularly it relates to an improved adapter apparatus for use in providing multiple electric outputs and providing multiple functions as a monitor and a protector for the power system in automobiles and the like.

2. Description of the Prior Art

The prior art includes a variety types of plural output electrical power adapters for insertion into the cigarette lighter socket in a vehicle, the adapters being designed to allow more than one accessory to be operated through the cigarette lighter socket.

The most pertinent reference appears to be U.S. Pat. No. 4,109,988 as issued on Aug. 29, 1978 in the name of Ernest E. Olson which relates to "Duplex Outlet Device". This patent teaches a device having a plug portion for insertion into a cigarette lighter socket including a pair of electric sockets for accepting auxiliary plugs for a variety of auxiliary equipment.

The U.S. Pat. No. 4,248,494 issued on Feb. 3, 1981 in the name of Edward S. McDonald, also shows a cigarette lighter adapter that allows more than one accessory to be plugged in.

The U.S. Pat. No. 4,054,352 issued on Oct. 18, 1977 in the name of Marvin B. Rudin discloses an adapter equipped with a plurality of power tapoffs for accommodating one or more accessory items.

Other U.S. Pat. No. 2,954,544 "Electrical Plug Connectors", U.S. Pat. No. 3,865,463 "Electrical Adapter Plug", U.S. Pat. No. 4,011,000 "Electrical Receptacle", U.S. Pat. No. 4,180,302 "Connector Plug for Vehicle Electrical Tester", U.S. Pat. No. 4,319,798 "Plug-in Connector for Use with Electrical Sockets in Motor Vehicles", U.S. Pat. No. 4,322,122 "Cigarette Lighter Plug Assembly", U.S. Pat. No. 4,740,167 "Power Distribution Unit for Modular Wall Panels", are representative of the art in general. There are also known power adapters having flexible connection cables.

In view of the foregoing, there is a need for a convenient source of electric power for multiple electrical and electronics accessories in a vehicle, a boat, and the like. In order to provide such an electric power source, at the same time, in order to provide the necessary protection for the vehicle power system when using those accessories, an improved power adapted should satisfy the following criteria to provide acceptance by a wide audience of vehicle drivers:

1. The adapter itself should be readily insatiable in a cigarette lighter socket by persons without special skills or who are not mechanically inclined;

2. The shape of the adapter should be flexible to meet the space requirement by the cigarette lighter socket in different vehicles, boats, and the like;

3. The body of the adapter should be rigid enough for easy reception of those add-on accessory equipment;

4. The adapter should be able to prevent excess usage of electric power by those add-on accessories either during driving or after engine stopped;

5. The adapter would be better to serve as a condition monitor for the engine power system.

These criteria are not available from prior patents, thus, they become the objectives of the present invention.

SUMMARY OF THE INVENTION

The present invention comprehends an improved structure for satisfying all of the aforesaid criteria. To this end, the invention provides an extender or adaptor on its master or basic module for insertion into the socket of a conventional cigarette lighter unit of a vehicle and the master module is constructed to receive the additional modules for application of add-on electrical accessories.

The master module provides a first socket for accommodating the cigarette lighter of the vehicle. Each of the additional modules has its own socket for accommodating an add-on accessory equipment. The master module may be combined with two or more additional modules in different ways to result in a suitable shape to fit the available mounting space in a specific vehicle. This combination can be quickly obtained by easy plug-in or pull-out of the additional modules from the master module. Each additional module may also receive another additional module.

The master module also includes an electronics circuit designed on a printed circuit board for automatically monitoring and controlling the power use of add-on accessories. This built-in circuit can also be used to test the condition of the battery, generator, and regulator in a vehicle.

The adapter of the present invention is very simple and economical of construction while yet providing the highly desirable features discussed above.

DESCRIPTION OF THE PREFERRED EMBODIMENT

Figure 1:
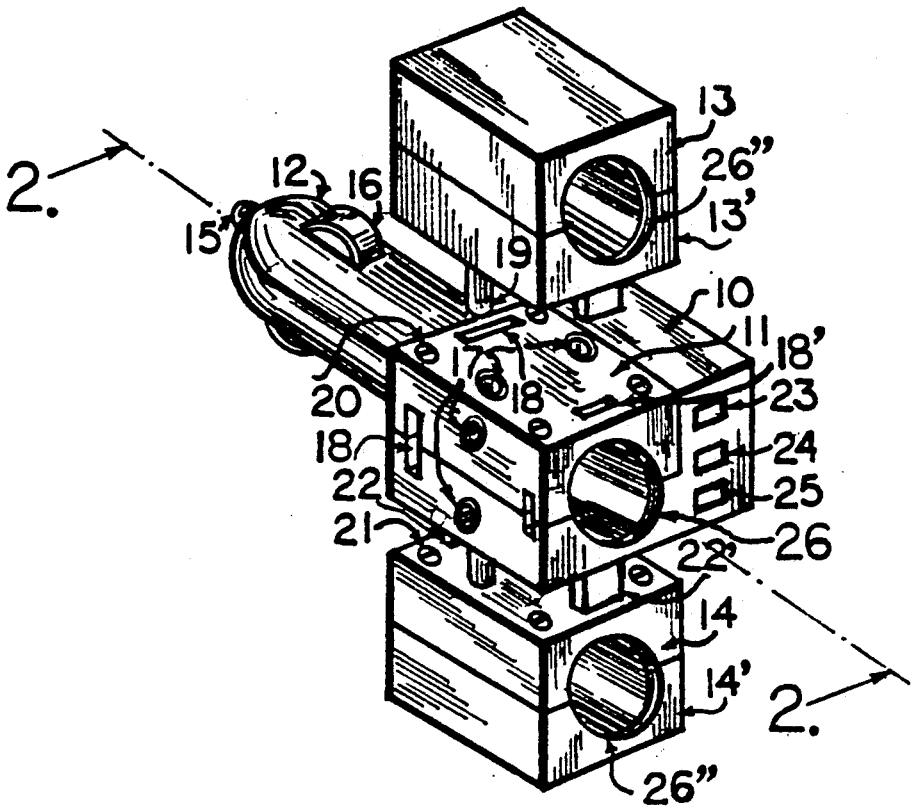
FIG. 1 is an enlarged perspective view of the present invention.

FIG. 1 illustrates the manner in which the power adapter is constructed and utilized. The master module shown at the middle of FIG. 1 comprises a plastic basic half 10 and a plastic top half 11, which are combined together by four screws 20 and form the well-known standard form of connector 12 for inserting the cigarette lighter in an automobile or the like.

The axially central contact 15 is connected to the positive or hot power lead while the spring metal contact 16 provides negative ground connection. Two identical additional modules are shown above and below the master module in FIG. 1. In a manner similar to the construction of the master module, each of the additional modules comprises a plastic top half (13 for the top module and 14 for the bottom module) and a plastic bottom half (13'40 for the top module and 14' for the bottom module), and four screws 21 are used to combine the top and bottom halves for each module. The power connection between the master module and each additional module is realized through two receipting rings 17 on the mast module and two connecting legs 19 on each additional module. Such a connection is secured further through the positioning holes 18 and 18' on the master module and the positioning pins 22 and 22' on each additional module. These positioning holes and pins are designed to allow only pin 22 has the correct size to match the hole 18 and only pin 22' can match the hole 18'. The power connecting legs 19 could not be inserted into the receipting rings 17 until these positioning pins 22 and 22' match the holes 18 and 18'. Therefore, the power leads will be always in correct contacts. Once these power connecting legs inserted into receipting rings, they will be hold there firmly due to the friction between positioning pins and holes, resulting in a solid adapter.

Figure 8:
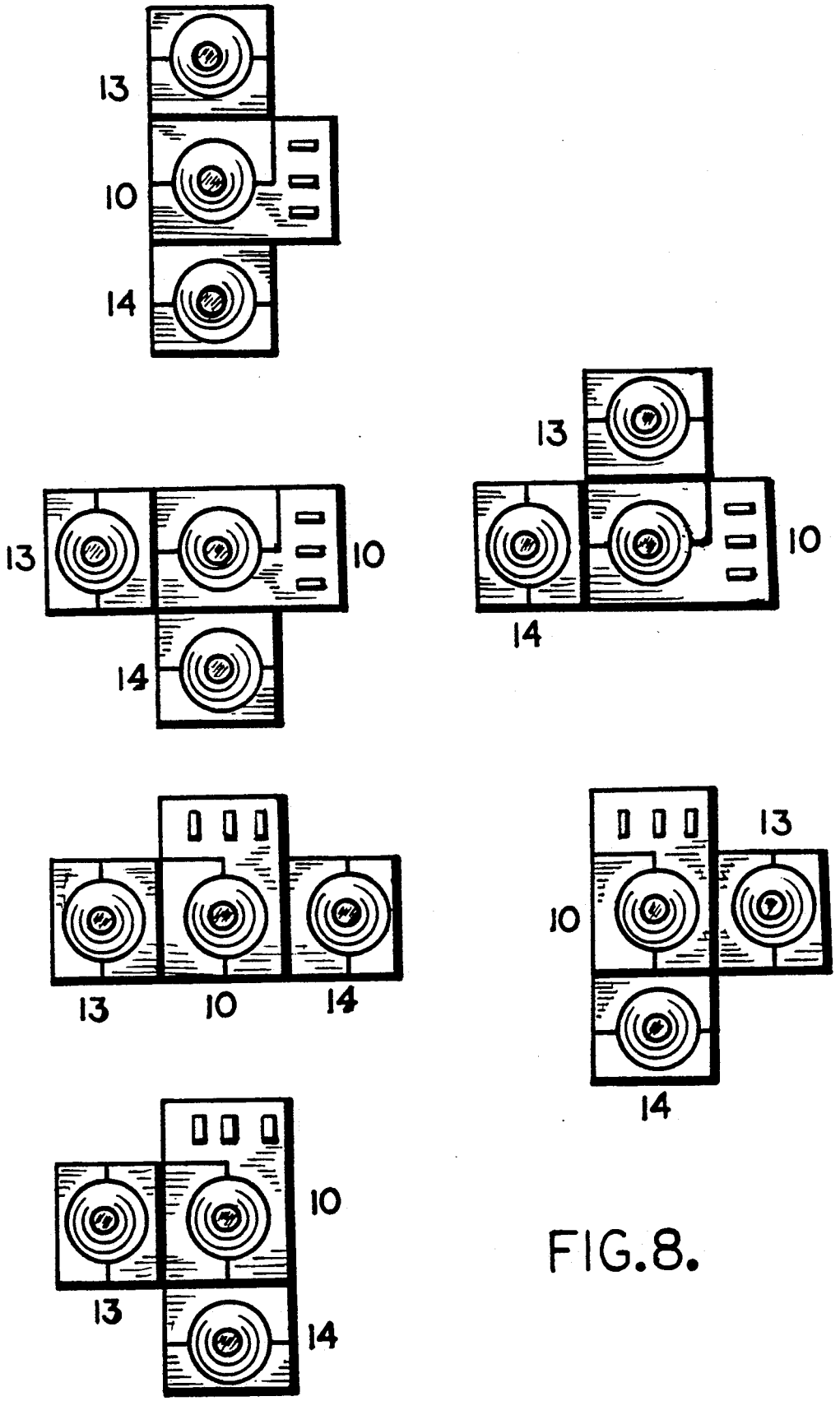
FIG. 8 is a schematic diagram showing the various shapes of the invention after combining the master module with two additional modules.
Figure 9:
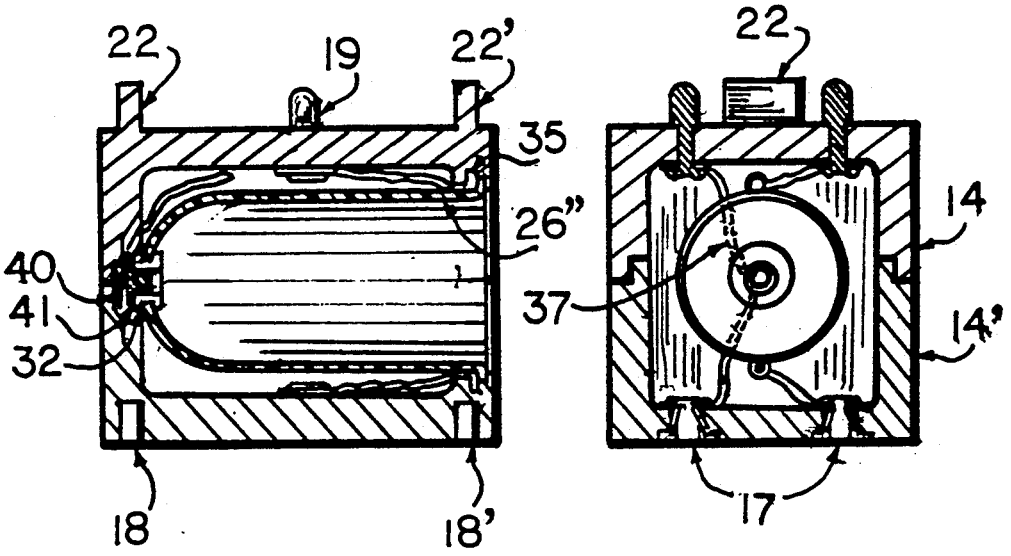
FIG. 9 illustrates the modification of internal structure of an additional module, shown in FIG. 5, to able to receive another module.

Furthermore, the master module has three sides having identical arrangement for the receipting rings 17 and positioning holes 18 and 18', allowing each side receives an additional module. Combining the master module with any two additional modules results in various shapes of an adapter as shown in FIG. 8 to fit various mounting spaces in different applications. Such a combination provides three cylindrical wall elements of receptacles, or sockets, 26, 26', and 26'', for the original cigarette lighter and other important accessories having standard power connectors. More additional modules can be added either by using the third side of the master module or by using modified additional modules that can receive another module as shown in FIG. 9.

Three light emitting diodes (LED), 23 (red), 24 (green), and 25 (yellow), mounted at the front of the master module, indicate the status of the electrical power system. This will be described in detail with the electronics circuit shown in FIG. 10.

Figures 2, 3, 4, 5, 6, 7:
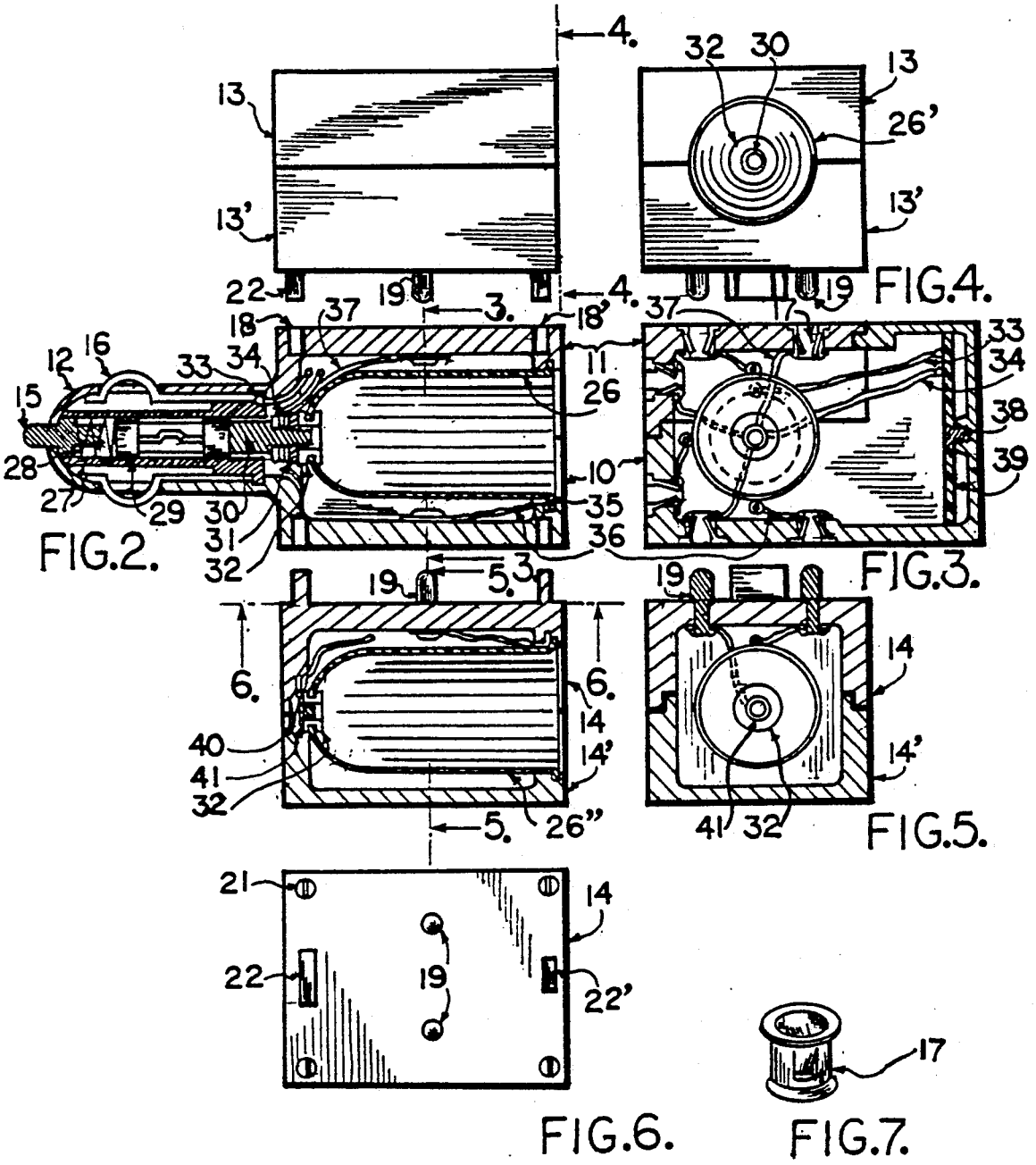
FIG. 2 is vertical view of FIG. 1 along lines 2—2 at the middle of this figure is the vertical section of the master module; on the top is the side elevation of the additional module, while at the bottom is the vertical section of the additional module.
FIG. 3 is a right plan view of the vertical section of the master module in FIG. 2 along lines 3—3.
FIG. 4 is a right plan view of the additional module in FIG. 2 along lines 4—4.
FIG. 5 is a right plan view of the vertical section of the additional module in FIG. 2 along lines 5—5.
FIG. 6 is a top plan view of the additional module in FIG. 2 along lines 6—6.
FIG. 7 is an enlarged perspective view of the receipting ring for power contact of the present invention in FIG. 3.

FIG. 2 to FIG. 6 illustrate the specific structure of both the master module and additional modules to implement the features described above. As shown in FIG. 2, the positive contact 15 and negative contact 16 are insulated by plastic housing 12 and 27. Insider the housing 27, there is a cylindrical fuse with one end connected with contact 15 by spring 28 and another end contacted with a cylindrical metal spacing 30. One end of the spacing 30 has thread to receive a small nut 31 that tightens the positive lead 34, which goes to the printed-circuit board 39 mounted by a central screw 38, then goes to the receipting rings 17 insider the master module. The flat end of the negative contact 16 is fixed by the housing 27 and its lead 33 also goes to the PC board, as seen in FIG. 3. The cylindrical wall elements 26 in master module and 26' and 26'' in additional modules are identical, with one open end mounted into a slot of the module, while another end having a small hole to hold a ring type insulator 32 through which the central positive end of a regular plug-in connector is allowed to contact the lead 30 in the master module or the lead 41 in additional modules. A small spring 40 is used to ensure lead 41 be tightly contacted with inserting central positive contact. The negative lead 36 has an end 35 to be inserted into a slot of the module to contact with the negative wall element 26. The receipting ring 17 is shown in FIG. 7. It is made by thin metal hose, two portions of its wall are punched toward inside to keep tight touch with inserting connecting legs 19 from an additional module. The ring has a rivet bottom end on which the ring-shaped end of lead 36 or 37 can be put and then be riveted together onto the master module (FIG. 1) or a modified additional module (FIG. 9). Thus, in the present invention, welding of power wiring is not necessary except for the PC board.

FIG. 3 illustrates the internal structure and the two halves 11 and 10 of the master module. FIG. 4 illustrates the appearance of two halves 13 and 13' of an additional module, while the internal structure of an additional module is shown in FIG. 5. FIG. 6 is the top plan view for such an additional module. FIG. 9 illustrates the modification of an additional module. By adding two receipting rings 17 and two positioning holes 18 and 18' on an unused side, the modified module is able to receive another module for more outlets.

Figure 10:
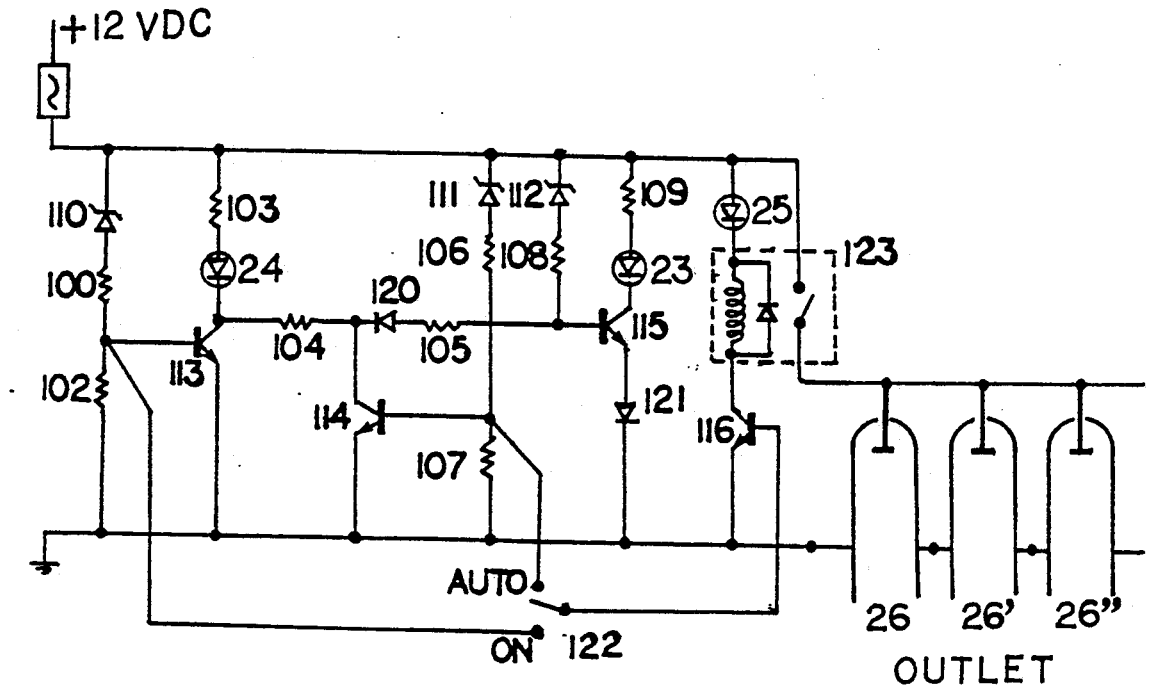
FIG. 10 is a schematic wiring diagram of the electronic circuit of the present invention designed and to be mounted on the printed-circuit board 39 in FIG. 3.

FIG. 10 illustrates the electronics circuit to perform the multiple functions as a monitor, a controller, and a tester of the DC electrical power system. Three zener diodes 110, 111, and 112 are selected as middle, high, and low voltage controllers, respectively. For the adapter used as a monitor and controller for accessory power use, when the engine is running and the switch 122 is at AUTO position, transistor 116 works if the voltage after diodes 111 is high enough, then a micro-relay 123 becomes close and the yellow LED 25 turns on, indicating additional accessories can be used through those additional modules 13 and 14 in FIG. 1. If the voltage drops below a limit due to excess usage of add-on accessories, transistor 116 stops working, the micro-relay 123 opens automatically to cut off the power supply to outlets and the yellow LED 25 turns off to inform the user to remove or adjust those add-on accessories. When the engine stops running, this circuit can automatically cut off the electrical drain to the outlet. Thus, the voltage level of the battery system is always kept above a normal limit no matter what the engine is running or stopped. When switch 122 is at ON position, use of add-on accessories is allowed within a short period after engine stops running. This is controlled by zener diode 110. When the voltage after diode 110 drops below a limit, transistor 116 stops working, yellow LED 25 turns off, indicating the electrical supply to the adapter is cut off.

For the adapter used as an electrical power system tester, similar to the meaning of road traffic light, the green LED 24 on always indicates a normal or pass condition while the red LED 23 on means something wrong in the power system.

The batter is tested when engine is not running. If the battery voltage is very low and only above the low level setting by diode 112, transistor 115 works then red LED 23 turns on. If the batter voltage level is normal, transistor 113 works so the green LED 24 turns on.

The test of generator and regulator is performed when engine is running. Similar to battery test, with this circuit, a normal condition is always represented by a single green LED 24 on. Initially both red LED 23 and green LED 24 on indicates a low voltage level due to the generator or the regulator; later on if the red LED 23 turns off, the charging system is normal; if the voltage becomes too high due to the generator or the regulator, the red LED 23 will turn on again.

This circuit is simple and cost effective. It can be designed as a PC board 39 mounted insider the master module 10.

Thus, the foregoing disclosure of specific embodiments is illustrative of the board inventive concepts comprehended by the invention. The module-type multi-function electric power adapted of the present invention provides a low cost, highly flexible and durable device for multiple power needs in automotive vehicles and the like having a conventional cigarette lighter socket, especially this invention provides a useful and necessary means for proper protection of the electric power system in vehicles and the like.

What I claim is:

1. A module-type multi-function electrical power adapter, for use with electrical cigarette lighter socket in automobiles and boats, which comprises:

a master module and additional modules, each provides a socket for accommodating one accessory, said master module having cylindrical extender insertable into the cigarette lighter socket and constructed to receive the two-prong power connection; said additional modules able to be attached to the said master module; each additional module also be able to receive another module; and housing means defining a plastic bottom half portion and a plastic top half portion, both having stepped edges for rigid combination by screws, forming a narrow round slot to hold a cylindrical wall element or socket for both said master module and said additional modules;

insulator means having ring shape to mount on a small end of said wall element to insulate a negative lead from a positive central lead in either said master module or said additional modules;

insulator means having cylindrical shape to insulate the central positive contact from outside negative contact in the said cylindrical extender of the said master module; having an enlarged outside end to hold a negative contact, having a cylindrical inner space to hold said positive contact, spring, electrical fuse, and spacing block;

positioning hole means on sides of the said master module, having rectangular shape to receive positioning pins with correct sizes from said additional module;

positioning pin means on the said additional module being able to match the said positioning holes on the said master module;

receiving ring means on sides of said master module, having side portions being punched inwardly to keep tight tough with inserting power connecting legs from said additional module, having one end to be riveted onto the said master module;

power connecting leg means on said additional module having cylindrical shape and shorter than said positioning pins to ensure correct power connection, having one end to be riveted onto the said additional module;

power lead means having ring-shaped ends to be inserted into a slot on said wall element or put under said power connecting legs or said receiving rings for easy assembly without welding;

inner structure means of the said master module having space for a printed-circuit board mounted by a central screw.

2. The module-type multi-function electrical power adapter of claim 1 wherein said printed-circuit board including an electronics circuit, which comprises:

indication means having three LEDs for power use and tester, one yellow LED for the allowance of additional accessories to be used through said adapter when engine running or stopped; the two other LEDs, red and green for working condition of battery, generator, and regulator;

switch means having two positions to allow automatic or delayed cut off of the power to outlets on the said modules when engine stopped;

power protector means having a circuit of zener diodes, transistors, micro-relay, and said yellow LED, to set voltage limit, turn on or cut off power to outlet automatically, and indicate the availability of power use;

tester means having circuit of resistors, transistors, and LEDs to indicate the condition of power supply system in a common-sense manner.

3. The module-type multi-function electrical power adapter of claim 1 wherein said additional module including a modified structure by adding positioning holes and receiving rings as those said ones on said master module to one unused side of said additional module, to receive another additional module for an extra accessory.

* * * * *